US005698265A

United States Patent [19]

Mucalo et al.

[11] Patent Number: 5,698,265

[45] Date of Patent: Dec. 16, 1997

[54] CALCIUM PHOSPHATE COMPOUND-CELLULOSE FIBER COMPOSITE MATERIAL AND METHOD FOR PRODUCTION THEREOF

[75] Inventors: Michael Roger Mucalo, Hamilton, New Zealand; Yoshiyuki Yokogawa, Komaki, Japan; Motohiro Toriyama, Kasugai, Japan; Yukari Kawamoto, Kawaguchi, Japan; Takahiro Suzuki, Nogoya, Japan; Kaori Nishizawa, Owari, Japan; Fukue Nagata; Hajime Nagae, both of Nagoya, Japan

[73] Assignee: Agency of Industrial Science & Technology, Ministry of International Trade & Industry, Tokyo, Japan

[21] Appl. No.: 607,885

[22] Filed: Feb. 27, 1996

[30] Foreign Application Priority Data

Mar. 29, 1995 [JP] Japan ..... 7-097772

[51] Int. Cl.[6] ..... B05D 3/04

[52] U.S. Cl. ..... 427/333; 427/337; 427/402; 427/324; 427/439

[58] Field of Search ..... 427/434.6, 439, 427/64, 121, 157, 158, 324, 334, 419.1, 403, 333, 402; 428/375, 393, 396

[56] References Cited

U.S. PATENT DOCUMENTS 3,546,755 12/1970 Lynch .
3,658,790 4/1972 Bernardin .
3,691,154 9/1972 Bernardin .
3,739,782 6/1973 Bernardin .
3,997,647 12/1976 Lassen .
4,049,764 9/1977 Sigl et al. .
4,297,407 10/1981 Manca ..... 428/393
4,486,234 12/1984 Herr ..... 106/18.14
5,334,741 8/1994 Quin et al. .

OTHER PUBLICATIONS

"Sen–i Gakkaishi", Fiber, vol. 49 (11), (pp. 417–421), 1993.

Boundary, vol. 11 No. 1, (pp. 22–23), 1995.

*Primary Examiner*—Patrick Ryan
*Assistant Examiner*—J. M. Gray
*Attorney, Agent, or Firm*—Oblon, Spivak, McClelland, Maier & Neustadt, P.C.

[57] ABSTRACT

A method for the production of a composite consisting of cellulose fibers coated with a calcium phosphate compound consists essentially of phosphorylating the surface of cellulose fibers, immersing the surface-phosphorylated cellulose fibers in an aqueous solution containing calcium ions and hydroxyl ions, removing the cellulose fibers from the aqueous solution and subsequently immersing them in an aqueous solution containing calcium ions and phosphoric acid ions, and then removing the cellulose fibers from the aqueous solution. Also disclosed is a composite produced by the method.

11 Claims, No Drawings

CALCIUM PHOSPHATE COMPOUND-CELLULOSE FIBER COMPOSITE MATERIAL AND METHOD FOR PRODUCTION THEREOF

BACKGROUND OF THE INVENTION

1. Field of the Invention

This invention relates to a calcium phosphate compound-cellulose fiber composite material and a method for the production thereof. More particularly, this invention relates to a composite material consisting of cellulose fibers coated with a calcium phosphate compound and a method for the production thereof. It specifically concerns a composite material consisting of a calcium phosphate compound bound fast chemically to cellulose fibers as a substrate and exhibiting outstanding properties and a method for producing this composite material with ease and expediency.

2. Prior Art Statement

Calcium phosphate compounds are used as medical prosthetic materials for teeth and bones in consideration of the fact that they constitute the main inorganic components of teeth and bones. Since calcium phosphate compounds also have a characteristic property of adsorbing proteins and viruses, studies are being made regarding their application in the production of chromato-graphic fillers used for separation and isolation and in the production of filter materials used for prevention of infection. The feasibility of producing composite materials of calcium phosphate compounds and cellulose fibers such as of pulp is also under study. The most suitable calcium phosphate compound for such applications is hydroxy-apatite.

Known methods for producing composite materials by coating cellulose fibers such as of pulp with a calcium phosphate compound include a method which comprises depositing granules of calcium phosphate compound fast on cellulose fibers as a substrate with the aid of a binder and a method which comprises immersing cellulose fibers as a substrate in an aqueous solution containing calcium ions and phosphoric acid ions, thereby inducing deposition of a calcium phosphate compound on the surface of the cellulose fibers ["Sen-i Gakkaishi," 49 (11), 417–421 (1993) and "Boundary," 1995 (1), 22–23 (1995)].

The coating layer of calcium phosphate compound formed by the above methods is thought to adhere to the cellulose fibers as the substrate either through the medium of a binder or by means of anchoring. Depending on the kind of binder and the surface condition of the substrate, the composite materials produced by these methods are susceptible to the problem of exfoliation of the calcium phosphate compound from the surface of the cellulose fibers while they are being used or being cleaned.

A need has therefore been felt for the development of a calcium phosphate compound coating composite consisting of a calcium phosphate compound in fast union with cellulose fibers as a substrate and of a method for producing the composite.

SUMMARY OF THE INVENTION

The present inventors have continued a study with a view to developing such a method. This invention was accomplished as a result.

Specifically, this invention is directed to a method for the production of a composite consisting of cellulose fibers coated with a calcium phosphate compound, which method consists essentially of phosphorylating the surface of cellulose fibers, immersing the surface-phosphorylated cellulose fibers in an aqueous solution containing calcium ions and hydroxyl ions, removing the cellulose fibers from the aqueous solution and subsequently immersing them in an aqueous solution containing calcium ions and phosphoric acid ions, and then removing the cellulose fibers from the aqueous solution, and a composite produced by the method.

DESCRIPTION OF THE PREFERRED EMBODIMENT

This invention will now be described in detail.

As mentioned above, this invention requires cellulose fibers with a phosphorylated surface to be immersed in an aqueous solution containing calcium ions and hydroxyl ions. The immersion in the aqueous solution is conducted at a temperature in the range of 20° to 50° C. for a period of one to ten days. The concentration of calcium ions in the aqueous solution, is preferably in the range of 0.002 mol/liter to 0.03 mol/liter and that of hydroxyl ions is preferably in the range of 0.002 mol/liter to 0.06 mol/liter.

If the temperature or the period of the retention of the cellulose fibers in the aqueous solution falls short of the lower limit of the range concerned or the concentration of the calcium ions or the hydroxyl ions in the aqueous solution is unduly low, the subsequent treatment by immersion in an aqueous solution containing calcium ions and phosphoric acid ions produces very little or no calcium phosphate compound and consequently fails to achieve the desired coating of the cellulose fibers. Conversely, increasing the temperature or the period of the retention beyond the upper limit of its range serves no useful purpose because it does not proportionately add to the effect of the immersion and may at times detract therefrom.

The ranges of the calcium ion and hydroxyl ion concentrations mentioned above include the respective saturation concentrations.

This invention further requires the cellulose fibers which have undergone the foregoing treatment to be immersed in an aqueous solution containing calcium ions and phosphoric acid ions. In this immersion, the concentration of calcium ions is in the range of 0.002 mol/liter to 0.08 mol/liter and that of phosphoric acid ions in the range of 0.001 mol/liter to 0.04 mol/liter, the temperature of retention in the range of 20° to 50° C., and the period of retention in the range of one to 14 days. If the temperature or the period of the retention of the cellulose fibers in the aqueous solution falls short of the lower limit of the range concerned or the concentration of the calcium ions or the phosphoric acid ions in the aqueous solution is unduly low, the desired coating layer of calcium phosphate compound is not formed. Conversely, increasing the temperature or the period of the retention beyond the upper limit of its range serves no useful purpose because it does not proportionately add to the effect of the immersion and may at times detract therefrom.

When the concentration of the calcium ions or the phosphoric acid ions is unduly high, it is difficult to form a uniform coat of calcium phosphate compound on the cellulose fibers.

The term "calcium phosphate compound" as used in the present specification refers to pertinent orthophosphate compounds. Hydroxylapatite, which is typical of these orthophosphate compounds, has the chemical formula:

$$Ca_{10}(PO_4,X)_6(OH,X)_2,$$

where X is $CO_3$.

The phosphorylation of the surface of the cellulose fibers in this invention will be explained below with reference to a preferred method using dimethyl formamide containing urea and phosphorous acid.

When the cellulose fibers are placed in the dimethyl formamide containing urea and phosphorous and or phosphoric acid and left to react therein at an elevated temperature in the range of 130° to 150° C. as swept with nitrogen, the surface of the cellulose fibers is phosphorylated. In this case, the cellulose fibers are bound chemically with phosphorus because the carbon atoms constituting a portion of the fibers are bonded through the medium of oxygen atoms to phosphorus atoms so as to form a C-O-P linkage. As typical examples of the cellulose fibers used herein, those of cotton and pulp may be cited. Cellulose derivatives such as cellulose fibers of rayon are also usable. This invention does not particularly specify the form of the cellulose fibers. The cellulose fibers are used in the form of fibers or a powder, for example.

In the dimethyl formamide to be used in the process described above, the weight ratio of urea to phosphorus acid is practically in the range of 1:0.5 to 1:3, preferably in the range of 1:0.6 to 1:0.7.

When the surface phosphorylated fibers are kept immersed in the aqueous solution containing calcium ions and hydroxyl ions at a temperature in the range of 20° to 50° C. for a period in the range of one to ten days, they undergo hydrolysis and consequent deposition of granules of calcium phosphite on their surface. For this hydrolysis, both calcium ions and hydroxyl ions are necessary. This reaction does not proceed satisfactorily if the aqueous solution contains the calcium ions alone. In order for this reaction to proceed satisfactorily, the retention of the fibers in the aqueous solution is preferably carried out at a temperature in the range of 20° to 50° C. for a period of one to ten days. The cellulose fibers subsequently removed from the aqueous solution are required to be thoroughly rinsed with water for removal of residual calcium ions which do not contribute to the reaction.

Then, the product of the reaction of hydrolysis mentioned above is immersed in an aqueous solution having a calcium ion concentration in the range of 0.002 mol/liter to 0.08 mol/liter and a phosphoric acid ion concentration in the range of 0.001 mol/liter to 0.04 mol/liter at a temperature preferably in the range of 20° C. to 50° C. The product of this immersion shortly begins to deposit on the cellulose fibers. When the temperature is set at 36.5° C., the calcium ion concentration at 0.00375 mol/liter, and the phosphoric acid ion concentration at 0.0015 mol/liter, for example, the cellulose fibers are covered densely and uniformly with the product by about ten days' immersion. This product was identified to be hydroxyapatite. No discernible separation of this product from the cellulose fibers is observed even when they are rinsed with water.

In the composite of this invention produced by the method described above, the cellulose fibers as a substrate and the calcium phosphate compound as a coating layer are chemically bound very fast. Unlike the conventional composite which, according to the well-known methods mentioned above, is produced by causing a calcium phosphate compound to be attached to cellulose fibers with the aid of a binder or by means of anchoring, the present composite is not susceptible to separation of the calcium phosphate compound from the cellulose fibers. The use of a binder inevitably reduces the adsorption ability of the produced composite because the binder covers the coating layer formed of the calcium phosphate compound. In the composite of this invention, on the other hand, the calcium phosphate compound capable of adsorption and desorption adheres fast to the surface of cellulose fibers.

This invention relates to a method for producing a composite of cellulose fibers coated with a calcium phosphate compound by phosphorylating the surface of cellulose fibers, immersing the surface-phosphorylated cellulose fibers in an aqueous solution containing calcium ions and hydroxyl ions, and then immersing the cellulose fibers in an aqueous solution containing calcium ions and phosphoric acid ions and to the composite produced by this method. In the composite of this invention, since the cellulose fibers as a substrate and the calcium phosphate compound as a coating layer are bound fast chemically, the possibility of the calcium phosphate compound being separated from the cellulose fibers is remote. The composite of this invention, therefore, is not susceptible to loss of adsorption and desorption ability.

Further, the method of this invention allows the cellulose fibers as the substrate to be uniformly coated with the calcium phosphate compound by a relatively easy and expeditious procedure of simply immersing the cellulose fibers having acquired a phosphorylated surface in an aqueous solution at a relatively low temperature.

Concrete examples of application of the composite material of this invention include chromatographic fillers for the separation and isolation of proteins and nucleic acids, masks for the filtration of viruses, and filter material for air cleaners.

This invention will now be described more specifically with reference to working examples.

EXAMPLE 1

500 ml of dimethyl formamide containing 40 g of urea and 3 g of minutely cut cotton was heated to 130° C. while being swept with nitrogen. The resultant solution was added with 100 ml of a dimethyl formamide solution containing 27 g of phosphorous acid, heated to a temperature in the range of 140° to 145° C., and refluxed with stirring for 30 minutes. The cotton was separated from the solution and then thoroughly washed with distilled water. In consequence of this procedure, the cotton acquired a phosphorylated surface. Micro-Fourier transform infrared spectrography clearly showed that the surface-phosphorylated cotton had a phosphate chemically bound thereto. The micro-Fourier transform infrared spectrography was carried out by converging the light directed onto a sample to a diameter of 10 to 50 microns, introducing the infrared region of the light reflected from the sample into an interferometer, measuring the intensity of the light emanating from the interferometer as a function of the distance of the motion of a movable mirror, and obtaining the spectrum of the light by means of Fourier transform. This spectrum had absorption peaks corresponding to several characteristic P-O stretching vibrations ranging between 1000 and 1200 $cm^{-1}$ and a P-H stretching vibration at 2360 $cm^{-1}$.

The surface-phosphorylated cotton obtained by the procedure described above was left standing in a saturated aqueous calcium hydroxide solution (having a calcium ion concentration of 0.02 mol and containing 0.04 mol of hydroxyl ions per liter) at room temperature continuously for 8 days. The cotton was then removed from the solution and thoroughly washed with distilled water. By observation under a scanning electron microscope, the cotton thus obtained was found to have a granular substance adhering to the surface thereof. By elementary analysis, the ratio of calcium to phosphorus was found to be 1:1. By micro- Fourier transform infrared spectrography, it was found that calcium phosphite hydrate was produced on the surface of the cotton. The scanning electron microscope was adapted to scan the surface of a sample with a converging electron beam, receive the radiated secondary electrons and reflected electrons into a detector, and display the detected electrons on a cathode ray tube as synchronized with the scanning motion. Thus, it enabled a morphological observation of the surface of the sample at a high magnification. By the analysis of energy dispersion, a minute portion of the sample could be subjected to elementary analysis.

The product of the procedure described above was then left standing in a solution containing 0.015 mol of phosphoric acid ions and 0.0375 mol of calcium ions per liter at 36.5° C. for ten days. By observation under the scanning electron microscope, it was found that a coating was densely deposited fast on the cotton fibers. In micro-Fourier transform infrared spectrography, the sample showed the absorption spectrum of hydroxyapatite. By elementary analysis, the ratio of calcium to phosphorus was found to be 1:1.67. Based on these data, the product on the cotton fibers was identified to be hydroxyapatite. To test for resistance to water, the product was washed with a stream of water running at a flow rate of 3 liters per minute for a total period of 10 minutes. No discernible separation of the product from the cotton fibers was observed in the test.

EXAMPLE 2

500 ml of dimethyl formamide containing 40 g of urea and 3 g of minutely cut pulp was heated to 130° C. while being swept with nitrogen. The resultant solution was added with 100 ml of a dimethyl formamide solution containing 27 g of phosphorous acid, heated to a temperature in the range of 140° to 145° C., and refluxed with stirring for 30 minutes. The pulp was separated from the solution, and then thoroughly washed with distilled water. In consequence of this procedure, the pulp acquired a phosphorylated surface. Micro-Fourier transform infrared spectrography clearly showed that the surface-phosphorylated pulp had a phosphate chemically bound thereto. The micro-Fourier transform infrared spectrography was carried out by converging the light directed onto a sample to a diameter of 10 to 50 microns, introducing the infrared region of the light reflected from the sample into an interferometer, measuring the intensity of the light emanating from the interferometer as a function of the distance of the motion of a movable mirror, and obtaining the spectrum of the light by means of Fourier transform. This spectrum had absorption peaks corresponding to several characteristic P-O stretching vibrations ranging between 1000 and 1200 $cm^{-1}$ and a P-H stretching vibration at 2360 $cm^{-1}$.

The surface-phosphorylated pulp obtained by the procedure described above was left standing in a saturated aqueous calcium hydroxide solution (having a calcium ion concentration of 0.02 mol and containing 0.04 mol of hydroxyl ions per liter) at room temperature continuously for 8 days. The pulp was then removed from the solution and thoroughly washed with distilled water. By observation under a scanning electron microscope, the pulp thus obtained was found to have a granular substance adhering to the surface thereof. By elementary analysis, the ratio of calcium to phosphorus was found to be 1:1. By micro-Fourier transform infrared spectrography, it was found that calcium phosphite hydrate was produced on the surface of pulp.

The product of the procedure described above was left standing in a solution containing 0.015 mol of phosphoric acid ions and 0.0375 mol of calcium ions per liter at 36.5° C. for 14 days. By observation under the scanning electron microscope, it was found that a coating was densely deposited fast on the cotton fibers. In micro-Fourier transform infrared spectrography, the sample showed the absorption spectrum of hydroxyapatite. By elementary analysis, the ratio of calcium to phosphorus was found to be 1:1.67. Based on these data, the product on the pulp fibers was identified to be hydroxyapatite. To test for resistance to water, the product was washed with a stream of water running at a flow rate of 3 liters per minute for a total period of 10 minutes. No discernible separation of the product from the cotton fibers was observed in the test.

We claim:

1. A method for preparing a composite consisting of cellulose fibers coated with a calcium phosphate compound, which method consists essentially of:

a) reacting cellulose fibers with a phosphorylating agent, thereby phosphorylating the surface of the cellulose fibers, b) immersing said surface-phosphorylated cellulose fibers in an aqueous solution containing calcium ions and hydroxy ions, thereby hydrolyzing the surface-phosphorylated cellulose fibers, c) removing said cellulose fibers from said aqueous solution and rinsing said cellulose fibers, thereby removing residual calcium ions from said cellulose fibers, d) subsequently immersing the cellulose fibers in an aqueous solution containing calcium ions and phosphoric acid ions, and e) subsequently removing said cellulose fibers from said aqueous solution.

2. The method of claim 1, wherein said reaction of said cellulose fibers with said phosphorylating agent is effected by placing said cellulose fibers in a dimethyl formamide solution containing urea and phosphorous acid and heating said solution to a temperature in the range of about 130° to 150° C., while sweeping said solution with nitrogen.

3. The method of claim 2, wherein a weight ratio of urea to phosphorus acid in a range of about 1:0.5 to about 1:3 is used.

4. The method of claim 3, wherein a weight ratio of urea to phosphorous acid in a range of about 1:0.6 to about 1:0.7 is used.

5. The method of claim 1, wherein said aqueous solution containing calcium ions and hydroxyl ions has a calcium ion concentration in the range of about 0.002 mol/liter to 0.03 mol/liter and a hydroxy ion concentration in the range of about 0.002 mol/liter to 0.06 mol/liter, the temperature of said aqueous solution being in the range of about 20° to 50° C., and the period of said immersion in said aqueous solution being in the range of from 1 to 10 days.

6. The method of claim 1, wherein said aqueous solution containing calcium ions and phosphoric acid ions has a calcium ion concentration in the range of about 0.002 mol/liter to 0.08 mol/liter and a phosphoric acid ion concentration in the range of about 0.001 mol/liter to 0.04 mol/liter, the temperature of said aqueous solution being in the range of about 20° to 50° C., and the period of said immersion in said aqueous solution being in the range of from 1 to 14 days.

7. The method of claim 1, wherein said cellulose fibers are selected from the group consisting of cotton and a cellulose compound.

8. The method of claim 1, wherein said cellulose fibers are in the form of pulp.

9. The method of claim 1, wherein said aqueous solution containing calcium ions and hydroxyl ions is an aqueous calcium hydroxide solution.

10. The method of claim 1, wherein said calcium phosphate compound is an orthophosphoric acid compound.

11. The method of claim 10, wherein said orthophosphoric acid compound is hydroxyapatite.

* * * * *